United States Patent [19]

Kölges et al.

[11] 4,443,289

[45] Apr. 17, 1984

[54] LABELING MACHINE FOR OBJECTS SUCH AS BOTTLES

[75] Inventors: Wilhelm Kölges, Meerbusch; Rudolph Zodrow, Düsseldorf, both of Fed. Rep. of Germany

[73] Assignee: Jagenberg Werke AG, Düsseldorf, Fed. Rep. of Germany

[21] Appl. No.: 427,245

[22] Filed: Sep. 29, 1982

[30] Foreign Application Priority Data

Dec. 16, 1981 [DE] Fed. Rep. of Germany ..... 3149886

[51] Int. Cl.[3] ..... B65C 9/16; B65C 9/46

[52] U.S. Cl. ..... 156/384; 156/380.9; 156/487; 156/568; 156/571; 156/DIG. 32; 156/DIG. 42; 156/DIG. 47

[58] Field of Search ..... 156/277, 487, 273.3, 156/275.5, 380–389, 567, 568, 571, 578, DIG. 32, DIG. 42, DIG. 47, DIG. 36

[56] References Cited

U.S. PATENT DOCUMENTS

| | | | |
|---|---|---|---|
| 3,201,299 | 8/1965 | Fairest | 156/487 |
| 3,893,388 | 7/1975 | Kronseder et al. | 156/571 |
| 4,040,887 | 8/1977 | Zodrow | 156/384 |
| 4,162,181 | 7/1979 | Zodrow | 156/384 |

FOREIGN PATENT DOCUMENTS 2843602 4/1980 Fed. Rep. of Germany .

*Primary Examiner*—Michael G. Wityshyn
*Attorney, Agent, or Firm*—Sprung, Horn, Kramer & Woods

[57] ABSTRACT

In a known bottle labeling machine having means for inking type and for contacting the type with a label for marking the label, there is provided an applicator for applying a label to a bottle without contacting the printed portion of the label. In addition a radiation source such as an ultraviolet lamp is provided adjacent the bottle path, the bottles being turned so that the labels, printed with an ultraviolet-sensitive ink, face the ultraviolet lamp.

7 Claims, 14 Drawing Figures

FIG. 11
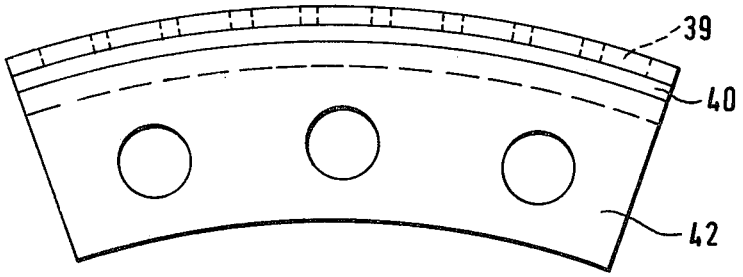
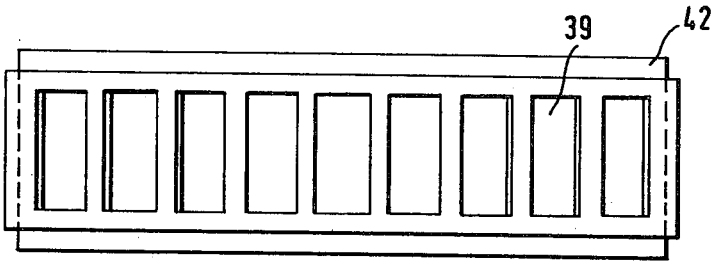
FIG. 12
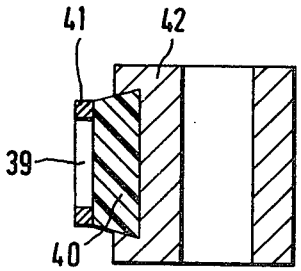
FIG. 13

LABELING MACHINE FOR OBJECTS SUCH AS BOTTLES

BACKGROUND OF THE INVENTION

The invention relates to a labeling machine for labeling objects such as bottles, consisting of a labeling station and a transport means for the objects, especially a turntable which moves the objects on controlled revolving platforms past a labeling station and has elements for applying the labels to the objects, the labeling station having at least one label pickup element provided with a convexly curved pickup surface and mounted and driven on a revolving carrier in a rotating or rocking movement by means of a shaft disposed at a fixed distance from the carrier axis, especially between the pickup surface and the center of its curvature, such that, in moving past a plurality of successive stations, such as a gluing device a label supply station, a label transfer station and an inking station, upon each rotation of the carrier the pickup element rolls its pickup surface against the uppermost, especially planar label of the label supply station and against the other stations, and consisting of a label marking station having at least one marking type disposed in an especially convexly curved field, which can be inked at an inking surface in an inking station, and on which the label-bearing pickup surface of each pickup element can be rolled upon rotation of the carrier.

In a known labeling station of this kind (U.S. Pat. No. 4,162,181), the practical construction of the required linkage and geometry between the marking element and the pickup element offers no problems, so that an optimum rolling of the marking type field against the pickup element in the area of the label that is to be imprinted is assured. In high-production labeling machines, however, difficulty is still involved in the practical achievement of the inking of the types by the inking ribbon or roller; the longer the marking type field is in the direction of rotation, the more problematical is the inking.

Whether the inking is performed by means of a ribbon running in synchronism with the type field or by means of a synchronized inking roller, the mechanical design is complex. In the case of a ribbon, the ribbon must be compliant in the radial direction of the carrier so as to be able to compensate for the different radial distance of the marking type field during rotation. For this purpose, an ink applicator roll runs under spring bias on the free length of the ink ribbon. If the inking of the marking type is performed by an inking roller and the marking type field exceeds a certain length, two or even three inking rollers must be disposed in tandem in the direction of rotation of the marking element so as to ink the marking type field in sections. A plurality of inking rollers requires an ink feeder roller for each. In such inking rollers the different radial controlling of the marking type field is compensated by yielding quality of the resilient periphery of the inking roller. In neither of the two cases can a uniform inking be achieved over the entire type field, in spite of the complexity of the design.

In another, older patent application, (German Pat. No. 3,118,775.5) not previously published, these disadvantages are avoided by the fact that the running direction of the inking roller or of the inking ribbon is across the running direction of the marking element, and that the inking roller or inking ribbon is given a concave profile on its outer periphery such that the type field rolls against the outer periphery when it rocks or turns.

While in the state of the art the effort was made to achieve the inking by synchronism between the marking type field and the inking roller or inking ribbon, the rolling is achieved in accordance with the invention exclusively by means of the geometry of the inking roller or inking ribbon, which is stationary while the marking element rotates or rocks. This kind of inking can be achieved constructionally in a comparatively simple manner.

In both of these labeling machines it is disadvantageous that the drying of the ink transferred to the label takes a certain amount of time. During this time the danger exists that the wipers which are to flatten the label fully against the bottle after it has been transferred thereto by the label transfer station, may smear the printing ink. The drying time, therefore, is a factor that limits the output of the machine.

THE INVENTION

It is the object of the invention to shorten the time required for the drying of the printing ink so that the labeling machine can be operated at a higher output.

This object is achieved by the fact that, within or directly behind the transfer area of the label transfer station, applicator elements acting on the transferred label are provided, which apply the label, without contacting the printed portion, to such an extent that it remains adhering to the object as transport continues, and in that, directly after the section of the transport path which contains the applicator elements, a radiation source is provided adjacent the path of movement of the objects and its radiation is aimed at the objects, while the rotational control of the rotating platforms holds the objects in a position in which their imprinted area faces the radiation from the radiation source, or turns them to such a position.

The ink drying time is shortened by the radiation that is directed by the radiation source against the marking. When the labeled containers reach the wipers, which also contact the label in its marked area, there is no longer the danger that the printing will be smeared. To arrive at a higher machine output, it is not necessary to lengthen the transport path of the containers. Since the marking as a rule does not extend over the entire length of the label but only over a comparatively short length, the time of action of the radiation on the marking would depend only on the velocity of movement of the containers without self-rotation, and thus would amount only to the time it takes for the marking to pass by, unless, in accordance with a further development of the invention, the control for the rotation of the platforms should rotate the containers contrary to the direction of movement, so as to prolong the time of action of the radiation on the printing.

It is especially advantageous if the apparatus is operated with a printing ink that dries under ultraviolet radiation, because this printing ink dries very rapidly under such radiation.

BRIEF DESCRIPTION OF THE DRAWINGS

The invention will be further explained with the aid of a drawing representing an embodiment, wherein:

FIG. 11 is a top view of a replaceable platen of a pickup element, FIG. 12 is a front view of the platen of FIG. 11, FIG. 13 is a cross section taken along line III—III of FIG. 10 through the platen of FIG. 11.

Figure 1:
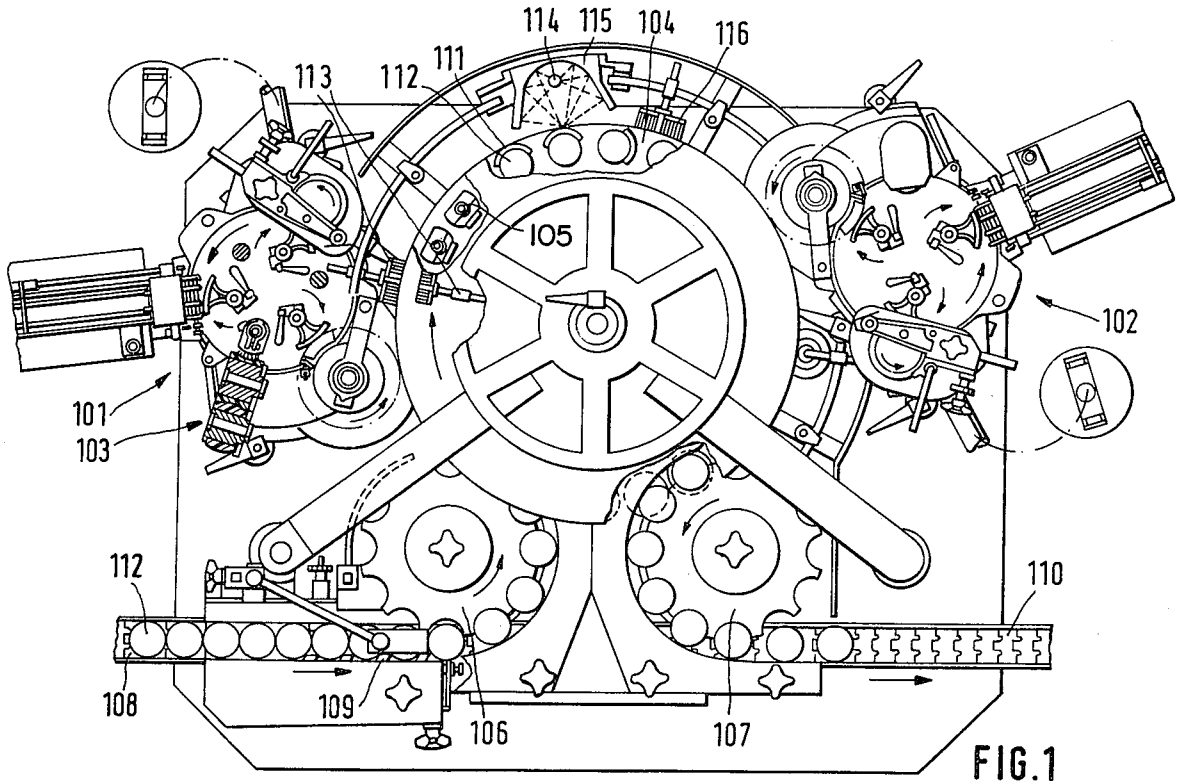
FIG. 1 is a diagrammatic plan view of a labeling machine consisting of a means for the transport of the objects, and of a labeling station.
Figure 2:
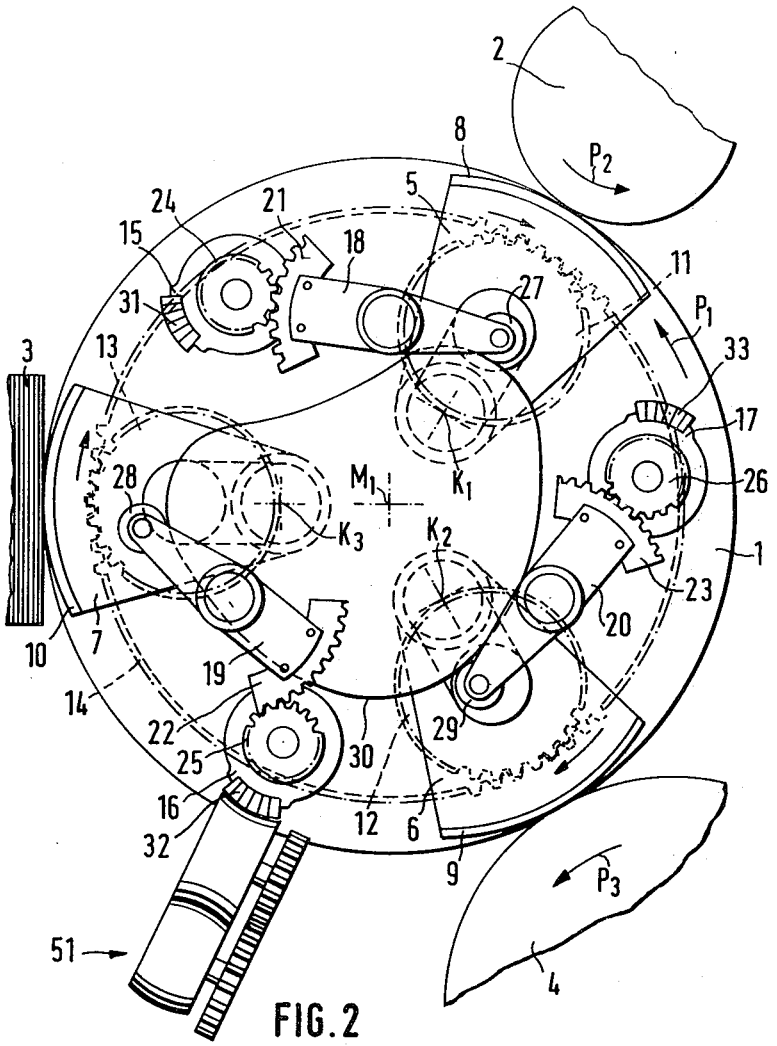
FIG. 2 is a diagrammatic plan view of the labeling station of the labeling machine of FIG. 1.

The labeling machine consists of a transport means and two labeling stations 101 and 102 which are of essentially the same construction. The labeling station 101 additionally has a marking station 103. The transport means consists of a rotor in the form of a turntable in whose outer part is a succession of receivers 105 consisting of a rotationally controlled platform and head. The bottles are gripped between the platform and the head during transportation, and thus they can be turned on their own axes.

The transport means furthermore includes an entrance wheel 106 and an exit wheel 107. The bottles pass over a conveyor belt 108 and a spacing worm 109 into the range of the entrance wheel 106 which transfers them to the receivers 105 of the turntable 104. After they are labeled, the bodies are transferred by the exit wheel 107 to the conveyor belt 110 adjoining the exit wheel 107.

The labeling station consists of a carrier 1 rotating in the direction of the arrow P1, and stations disposed successively along its periphery, namely a glue roller 2 rotating in the direction of the arrow P2, a stationary label supply station 3 containing a stack of labels, and a gripper cylinder 4 rotating in the direction of the arrow P3. The glue roller 2 and the gripper cylinder are geared to run in synchronism with the carrier 1.

The carrier 1 bears three similar pickup elements 5, 6 and 7, which are distributed about the same circle, eccentrically from the center M1 of the carrier 1. Each pickup element 5, 6 and 7 has a cylindrically curved receiving surface 8, 9 and 10, and is rotatably mounted in the carrier 1 between these receiving surfaces 8, 9 and 10 and the corresponding center of curvature K1, K2, K3. A planet gear 11, 12, 13, which meshes with a fixed sun gear 14, serves as the drive. With the carrier 1 rotating uniformly, in order to convert the uniform rotary movement of the pickup elements 5–7 resulting from the planetary gear train 11–14, to an irregular rotary movement which is necessary for the rolling of the receiving surfaces 8–10 against the various stations 2–4, a cam-controlled irregular drive is provided in the gear train of each pickup element 5–7, which is described, for example, in U.S. Pat. No. 3,928,120. Instead of a drive of this kind, it is of course possible to provide any other drive assuring the irregularity of the self-rotation of the pickup elements, such as for example a pin wheel drive in accordance with German Offenlegungsschrift No. 2,843,602.

With each pickup element 5–7 there is associated a marking elements 15–17, which is disposed in the free space between adjoining pickup elements 5–7 for rotation or, in the present case, pivoting, on the carrier 1. The drive of each marking element 15–17 is a gear segment 21, 22, 23, borne by a two-armed lever 18, 19, 20, and meshing with a pinion 24, 25, 26, of the marking element 15–17. With a cam follower 27, 28, 29, each lever follows a fixed cam 30. The cam 30 makes it possible for the marking element 15–17 to be driven irregularly upon the rotation of the carrier 1.

Figure 8:
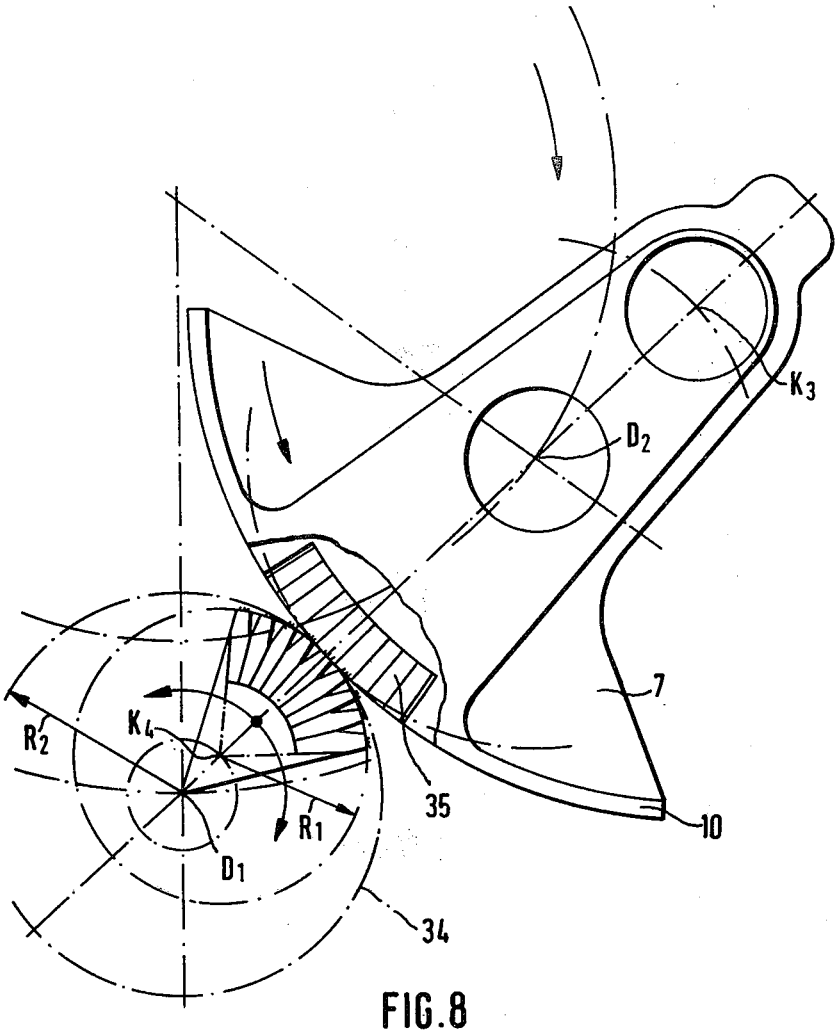
FIG. 8 is an enlarged representation of the pickup element of the labeling station of FIG. 1, showing a marking element represented diagrammatically.
Figure 10:
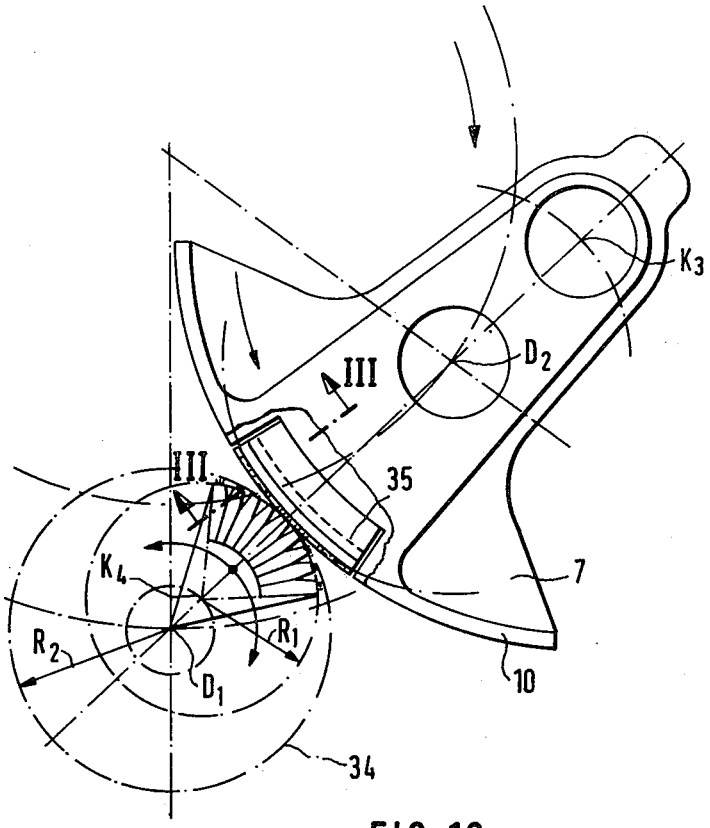
FIG. 10 shows an enlargement of the pickup element of the labeling station of FIG. 1, together with a diagrammatically represented marking element, in a modified embodiment differing from FIG. 8.

Each printing element 15–17 bears a circumferential succession of marking types forming a convexly arcuate marking type field 31, 32, 33. In the enlarged views presented by FIGS. 8 and 10 it can be seen that the radius of curvature R1 of the printing type field is smaller than the radius R2 of the path of rotation 34 of the type field, and that the center of rotation D1 of the marking element is diametrically opposite the marking type field with respect to its center of curvature K4. In the case of the pickup element, these geometrical circumstances are precisely reversed, namely in this case the center of rotation D2 lies between the curved receiving surface 10 and its center of curvature K3. In consideration of these geometrical circumstances, a replaceable platen 35 is embedded in the receiving surface 8–10 of each pickup element 5–7, and the marking type field rolls against it.

To prevent the printing type field 31–33 and with it the entire printing station 51 from becoming contaminated with glue when the machine is running idle (no label, no bottle), the outer side of the platen 35 can be recessed below the receiving surface 10 of the pickup element 7. The same effect is achieved if the platen is provided with recesses 37. The receiving surface of the pickup elements can also serve as the platen if the marking types are flat types consisting of a resilient material such as Vulkolan. In this case, recesses are provided in the receiving surface 10. In none of these cases do the marking types come in contact with glue, so that the types themselves are not contaminated nor do they contaminate the inking station with glue.

Figure 9:
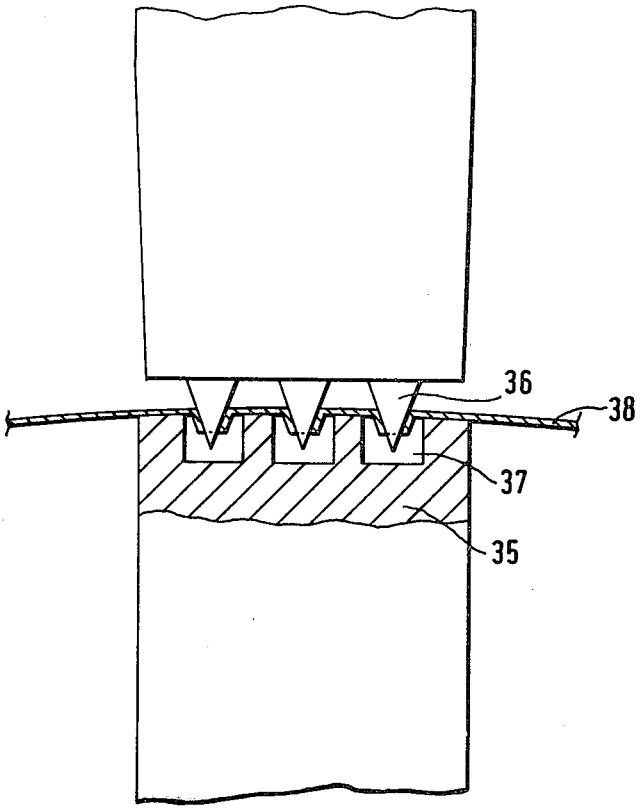
FIG. 9 shows a type of the marking element in FIG. 8 with the associated portion of the platen in the receiving surface of the pickup element of FIG. 8.

Each printing field 31–33 is formed, as stated, of a plurality of types disposed in circumferential succession. As FIG. 9 shows, each type consists of a plurality of conical or pyramidal points 36. These points 36 are associated with recesses 37 in the platen 35 such that, when the type field rolls against the platen 35, the points 36 penetrate and thus perforate the label 38. The recesses 37 are so large that the pushed-in margins of the perforations in label 38 will not become gripped between the point 36 and the edge of the recess 37. Whereas in the case of the embodiment represented in FIG. 9, each point 36 is provided with a recess 37 of its own, up to a total of 12 points on a type can be associated with one common recess 37 in the embodiment shown in FIG. 10. In both cases, the label spans the recess 37, 39, so that the label is merely pierced, but parts of the label are not gripped and then torn.

The recesses 37 can, as in the case of the embodiment shown in FIG. 9, be in the form of platens 35 in the form of cushions. Preferably they are formed by apertures in a mask 41 placed on a flexible cushion 40. In both cases the cushion can be disposed on a holder 42 replaceably set in the recess in the receiving surface 8–10.

Figure 3:
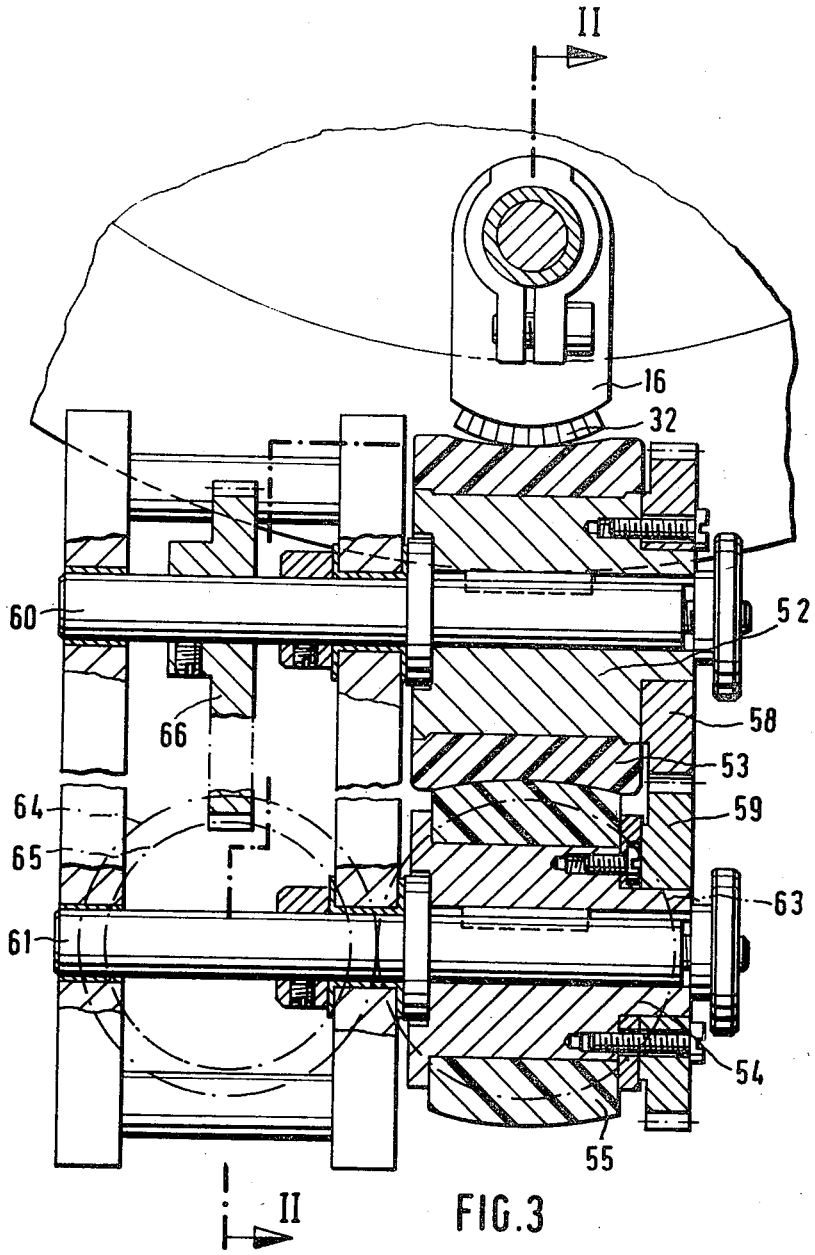
FIG. 3 shows a marking station in cross section along line I—I of FIG. 4.
Figure 4:
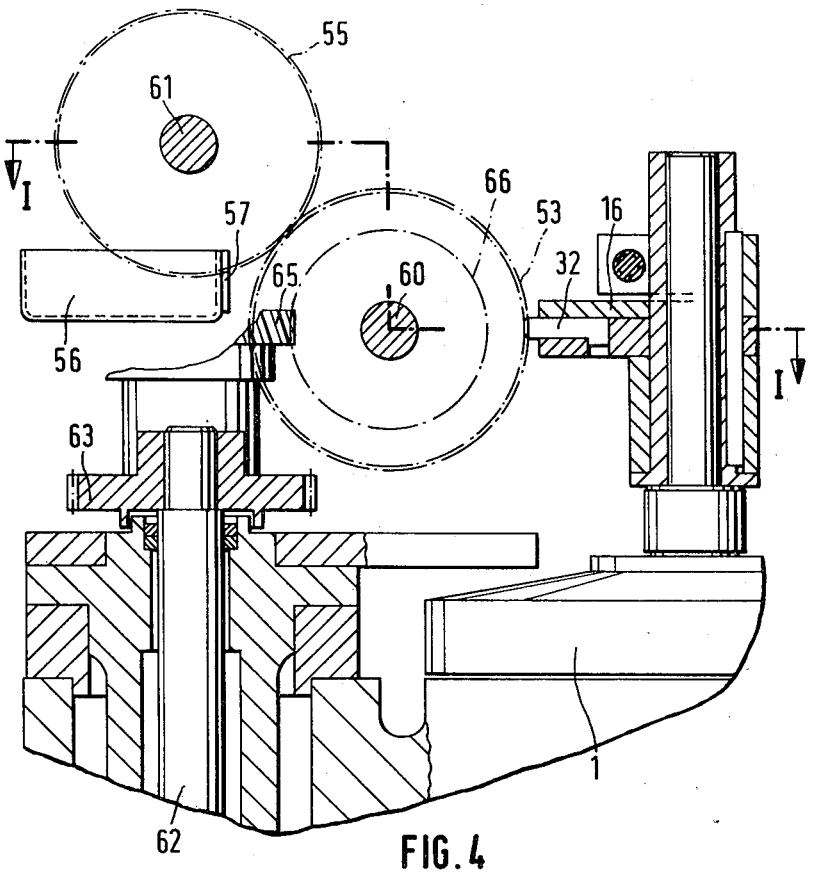
FIG. 4 is a cross sectional view taken along line II—of FIG. 3, FIGS. 5 to 7 are top views of the printing element and a portion of the inking roller during different phases of operation.
Figure 5:
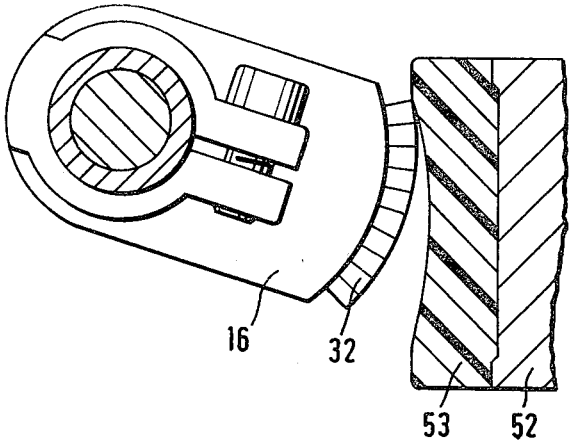
Figure 6:
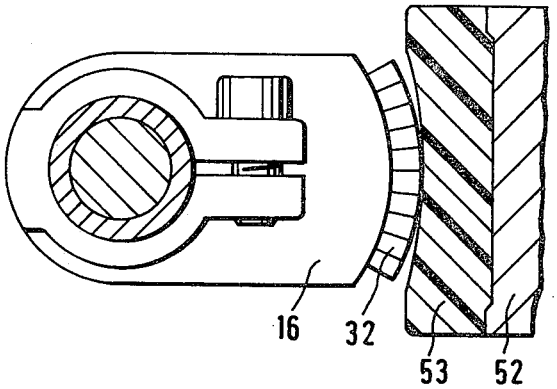
Figure 7:
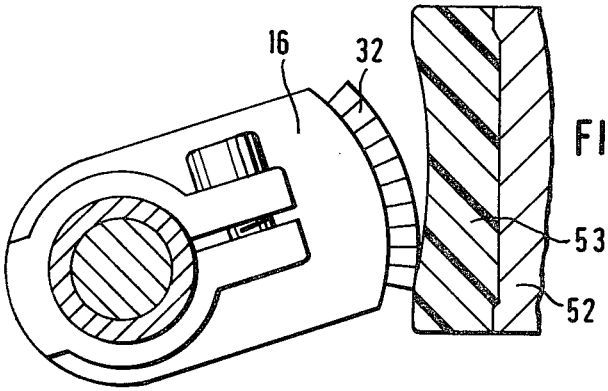

For the inking of the marking type segments 31–33, an inking station 51 is provided on the outer periphery of the carrier 1 between the label supply station 3 and the gripper cylinder 4. The inking station 51 consists, as shown in detail in FIGS. 3 and 4, essentially of a revolving ink roller 52 having a concave-faced inking roller 53 made of a resilient material suitable for picking up and yielding ink (Vulkolan with a Shore hardness of 25 to 40), an ink feed roller 54 which rolls thereon and has a barrel-shaped periphery 55, especially one made of porous material such as sponge rubber, and an ink well 56 in which the ink feed roller 54 is partially immersed. By means of a scraper 57 disposed on the front edge of the ink well 56, the excess ink is scraped from the periphery 55. Both of the rollers 52 and 54 are drivingly coupled together by gears 58 and 59. The parallel shafts 60 and 61 are perpendicular to the axes of rotation or pivoting of the other revolving parts of the labeling station, especially to the axes of rotation of the marking elements 15–17, such that the marking types segments 31–33 can roll without slippage on the concavely shaped outer circumference of the inking roller 53.

The drive for the inking station 51 is derived from the main drives of the carrier 1. This simplifies synchronization between the marking element 16 and the inking roller 53, which preferably rotates only step-wise. As previously mentioned, the inking roller 53 is to be still during the entire inking phase so as to forestall any relative movement. In practice, this step-wise rotation can be accomplished by means of a stepping drive which consists of a crank wheel continuously driven by the main drive of the carrier 1, a ratchet, and a ratchet wheel, and acts on the shaft 62 so that the latter is rotated step-wise. Through a gear train 63, 64, the shaft 62 drives a helical gear 65 which meshes with a pinion 66 mounted on the drive shaft 60 of the inking roller 52–53.

As an alternative to the recessing of the outside of the counterholder 35 below the receiving surface 10 of the pickup element 7, or also additionally, the contamination of the marking types 31 can be prevented by causing the inking station as well as the label supply station 33 to retract when the machine is operated without objects to be labeled and without labels. This kind of control will be useful especially when no labels are being applied over a relatively long period of time.

By means of the gripper cylinder 4, the labeling station 101 transfers the marked label 111 to the container 112. To prevent the label 111, which is held on only a narrow portion by the strickiness of the glue, from sagging downwardly as transport continues, the container is first turned by 90° by the platform control, such that the label is situated forwardly in the transport direction. In this position, the bottle 112 is moved past brushes 113 disposed on both sides of the path of transport, but these brushes contact only the unmarked portions of the label 111, and lay the label down to such an extent that there is no longer any danger that it will sag downward as transport continues. As the bottle is carried along, it is again turned back 90° by the platform control, so that the label 111 will be turned so that the marking will face a radiation source consisting of an ultraviolet lamp 114 and a reflector 115 disposed externally along the path of transport. Since the marking as a rule extends over only a short section of the entire label length and, if the container is not rotated on itself, the time of action of the radiation on the marking is correspondingly short, provision is made in the invention for increasing the time of action of the radiation on the marked area by rotating the bottles 112 counterclockwise while the turntable 104 is rotating clockwise. As soon as the bottles 112 move out of range of the ultraviolet radiation source 114–115, they are further rotated so that the laying down of the labels 111 can be completed by additional smoothing elements 116 disposed along the path.

The brushes 113 can be omitted if, during the transfer of the label 111 onto the bottle by the gripper cylinder, the label is laid down—by air jets for example—such that it will not slip downward during further transport. In this case, the turning control does not, of course, need to turn the container as it travels toward the radiation source 114, 115.

Figure 14:
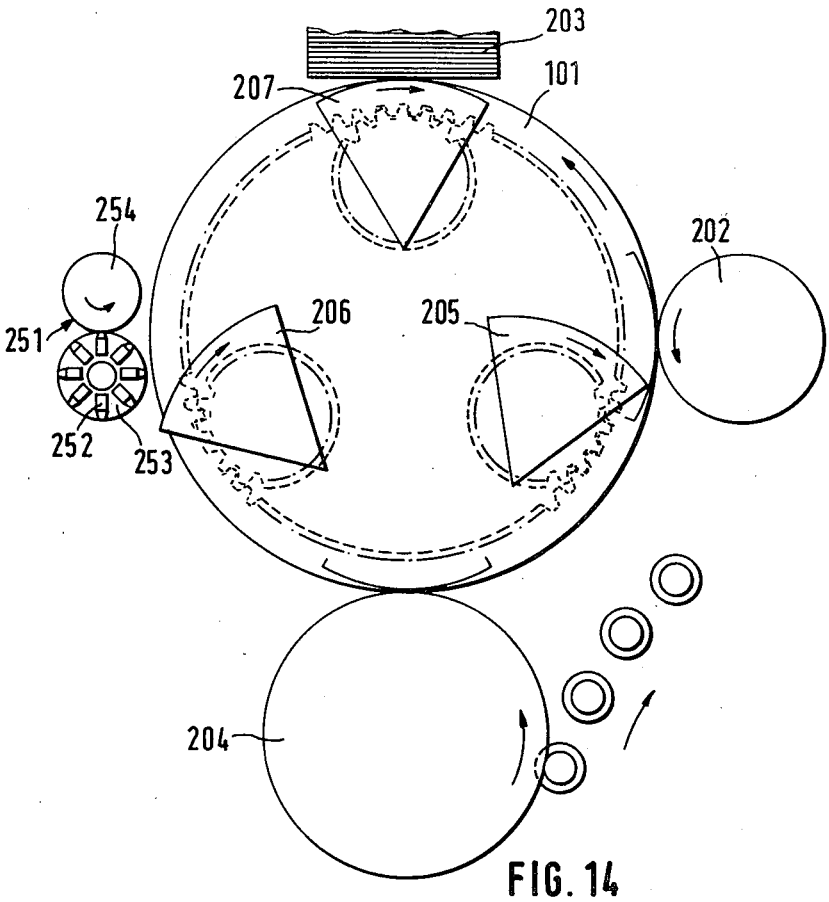
FIG. 14 is a diagrammatic plan view of a modification of the labeling station of FIG. 2, with a modified marking station.

In the case of the embodiment of the labeling station. represented in FIG. 14, the marking elements are disposed not on the carrier 101 of the pickup elements 205, 206, 207, but outside of the carrier, like the other stations 202, 203 and 204. The marking station 251 consists of a plurality of similar marking elements 252 whose type field is perpendicular to the plane of the drawing. The marking elements 252 form a wheel which, as the carrier 101 revolves, is turned step-wise, the type segment rolling against an inking roller 254. At the moment of the printing of a label borne by the receiving surface of a pickup element 205–207, the wheel 253 stands still. Since the pickup elements 205 to 207 can roll without slippage on variously curved surfaces on account of their controlled turning or revolving movement, the surface of the type field can be of any desired shape. It is important only that the type field lie in the plane of the rolling of the pickup elements 205 to 207.

It is also possible for the carrier 253 to rotate continuously during the inking. In this case, the rolling conditions are similar to those of the glue roller.

It will be appreciated that the instant specification and examples are set forth by way of illustration and not limitation, and that various modifications and changes may be made without departing from the spirit and scope of the present invention.

We claim:

1. In a machine for labeling objects such as bottles, comprising a gluing station, a label supply station, a label transfer station and a label marking station, a turntable which moves the objects on controlled revolving platforms past the stations, the label transfer station having at least one label pickup element provided with a convexly curved pickup surface and mounted and driven on a revolving carrier in a rotating or rocking movement by means of a shaft disposed at a fixed distance from the carrier axis between the pickup surface and the center of its curvature so that upon each rotation of the carrier the pickup surface of the pickup element rolls against the uppermost label of the label supply station and against the other stations, the label marking station having an inking station and at least one marking type disposed in a convexly curved field, which type is inked at the inking station upon rotation of the carrier, the label-bearing pickup surface of each pickup element rolling on the inked type, the improvement which comprises providing applicator means within or directly behind the transfer area of the label transfer station, the applicator means applying the transferred label, without contacting the printed portion, to the object in such manner that the label adheres to the object as transport continues, a radiation source directly following the section of the transport path with the applicator means and positioned adjacent the path of movement of the objects with its radiation aimed at the objects, and control means for the rotating platforms so as to hold the objects in a position in which their imprinted area faces the radiation from the radiation source.

2. A labeling machine according to claim 1, including a marking element for each pickup element and mounted for rotation or rocking on the carrier, the label marking station including a common inking station for all marking elements and provided between the label supply station and the transfer station.

3. A labeling machine according to claim 1, including a common marking station for all pickup elements positioned adjacent the carrier between the label supply station and the transfer station.

4. A labeling machine according to claim 1, wherein the control means turns the objects during their transport so that the labels face and are acted upon the radiation source.

5. A labeling machine according to claim 1, wherein the radiation source emits ultraviolet radiation and the inking station applies printing ink which dries under the action of ultraviolet rays.

6. A labeling machine according to claim 5, including a reflector associated with the ultraviolet radiation emitter.

7. A labeling machine according to claim 2, wherein the axis of rotation of each marking element mounted on the carrier lies diametrically opposite the curved marking type field with respect to the center of curvature of the curved surface, and wherein the inking station comprises a revolving inking roller or revolving inking ribbon for the marking element or elements, the running direction of the inking roller or of the inking ribbon crossing the running direction of each marking element, the inking roller or the inking ribbon being profiled concavely on its outer periphery so that the type field rolls on the outer periphery upon the turning or rotation of the marking element.

* * * * *